US009132598B2

(12) United States Patent
Ernst

(10) Patent No.: US 9,132,598 B2
(45) Date of Patent: Sep. 15, 2015

(54) COMBINATION COOLER AND CAN CRUSHER

(71) Applicant: Ellis Clinton Ernst, San Antonio, TX (US)

(72) Inventor: Ellis Clinton Ernst, San Antonio, TX (US)

( * ) Notice: Subject to any disclaimer, the term of this patent is extended or adjusted under 35 U.S.C. 154(b) by 110 days.

(21) Appl. No.: 14/053,874

(22) Filed: Oct. 15, 2013

(65) Prior Publication Data

US 2015/0101498 A1 Apr. 16, 2015

(51) Int. Cl.

*B30B 9/32* (2006.01)
*B30B 1/04* (2006.01)
*F25D 3/08* (2006.01)

(52) U.S. Cl.

CPC . *B30B 9/321* (2013.01); *B30B 1/04* (2013.01); *F25D 3/08* (2013.01)

(58) Field of Classification Search

CPC ..... B30B 1/04; B30B 9/321; B30B 9/323; F25D 3/08
USPC ..... 100/100, 102, 265, 283, 293, 902; 220/908; 62/331, 457.4, 457.5, 457.7
See application file for complete search history.

(56) References Cited

U.S. PATENT DOCUMENTS

| | | | | |
|---|---|---|---|---|
| 2,493,193 | A * | 1/1950 | Hait | 100/233 |
| 4,195,796 | A * | 4/1980 | Osanai | 242/337.1 |
| 4,962,701 | A * | 10/1990 | Stralow | 100/215 |
| 5,090,308 | A * | 2/1992 | Wang | 100/215 |
| 5,179,893 | A * | 1/1993 | Richardson | 100/98 R |
| 5,263,338 | A * | 11/1993 | Banks | 62/331 |
| 6,796,319 | B1 * | 9/2004 | Patarra et al. | 135/16 |

* cited by examiner

*Primary Examiner* — Jimmy T Nguyen

(57) ABSTRACT

A combination cooler and can crusher is an apparatus assembly that allows a user to compact empty aluminum beverage cans for facilitated transport. The apparatus combines a cooler with an integrated wheel assembly with a can crushing mechanism. The integrated wheel allows a user to transport a large quantity of food and beverage items to an event. The can crushing mechanism provides the user to compact emptied aluminum beverages cans for facilitated transport upon leaving the event. The apparatus accomplishes both functions in a compact design by integrating the can crushing mechanism with the elongated handle of the cooler with integrated wheel assembly.

10 Claims, 8 Drawing Sheets

COMBINATION COOLER AND CAN CRUSHER

FIELD OF THE INVENTION

The present invention relates generally to an insulated storage container, more specifically to an insulated storage container incorporates a can crusher in order to compact empty aluminium beverage cans.

BACKGROUND OF THE INVENTION

It is well known that coolers are portable insulated containers that are used to keep food and drinks cool. Coolers are generally used at various outdoor events and gatherings where refrigeration is not widely available. One of the most common items stored within coolers at various outdoor events and gatherings are aluminium beverage cans. Aluminium beverage cans are widely preferred to other beverage containers due to their ease of storage and the inherent properties of the aluminium body to quickly transfer heat, allowing an aluminium beverage can to be cooled faster than a glass or plastic beverage container. Furthermore many outdoor events and gatherings restrict the use of glass bottles due to safety concerns associated with broken glass.

A typical cooler configuration found at many outdoor events and gatherings are coolers with an integrated wheel assembly. These coolers with an integrated wheel assembly provide a user with a facilitated means of transporting a fully stocked cooler over greater distances. These coolers generally comprise a typical cooler housing with a wheel assembly positioned at one end and an elongated handle positioned at the opposite end. A user would transport these coolers by raising the elongated handle pivoting the coolers about the wheel assembly. With the cooler pivoting on the wheel assembly the user would be able to pull the cooler with only the wheel assembly engages ground. By providing a cooler with an integrated wheel assembly, the user would be able to transport a greater quantity of food and beverages to an outdoor event or gathering.

A typical problem faced by many event goers is the disposal of the empty aluminium beverage cans. Similar to other beverage containers, users are encouraged to recycle aluminium beverage cans rather than simply throw them away. In some areas, empty aluminium beverage cans can be brought to recycling centers and exchanged for a small sum of money. As a result, many users choose to take their empty aluminium beverage cans home with them. While the benefits of recycling are well known, transporting empty aluminium beverage cans following an outdoor event can be cumbersome and inconvenient. This is mostly due to the volume taken up by the empty aluminium beverage cans.

It is therefore the object of the present invention to provide a combination cooler and can crusher that allows users to compact empty aluminium beverage cans for facilitated transport. The present invention combines a cooler with an integrated wheel assembly with a can crushing mechanism. The present invention allows a user to transport a large quantity of food and beverage items to an event and provides the user with a means to compact emptied aluminium beverages cans for facilitated transport upon leaving said event. The present invention accomplishes this by integrating the can crushing mechanism with the elongated handle of the cooler with integrated wheel assembly.

BRIEF DESCRIPTIONS OF THE DRAWINGS

DETAIL DESCRIPTIONS OF THE INVENTION

All illustrations of the drawings are for the purpose of describing selected versions of the present invention and are not intended to limit the scope of the present invention.

Figure 1:
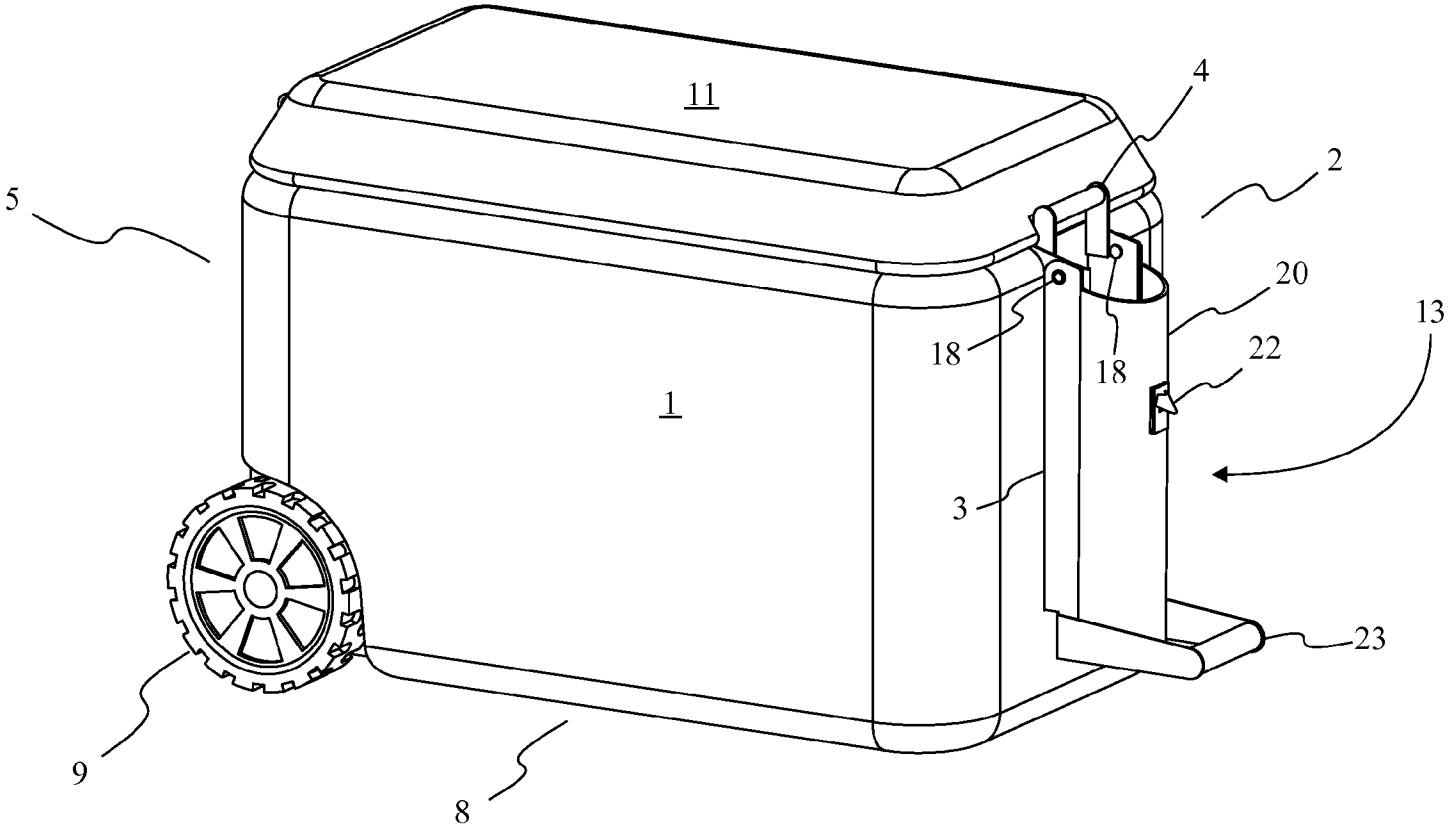
FIG. 1 is a front perspective view displaying the combination cooler and can crusher with the lid enclosing the interior chamber as per the current embodiment of the present invention.
Figure 2:
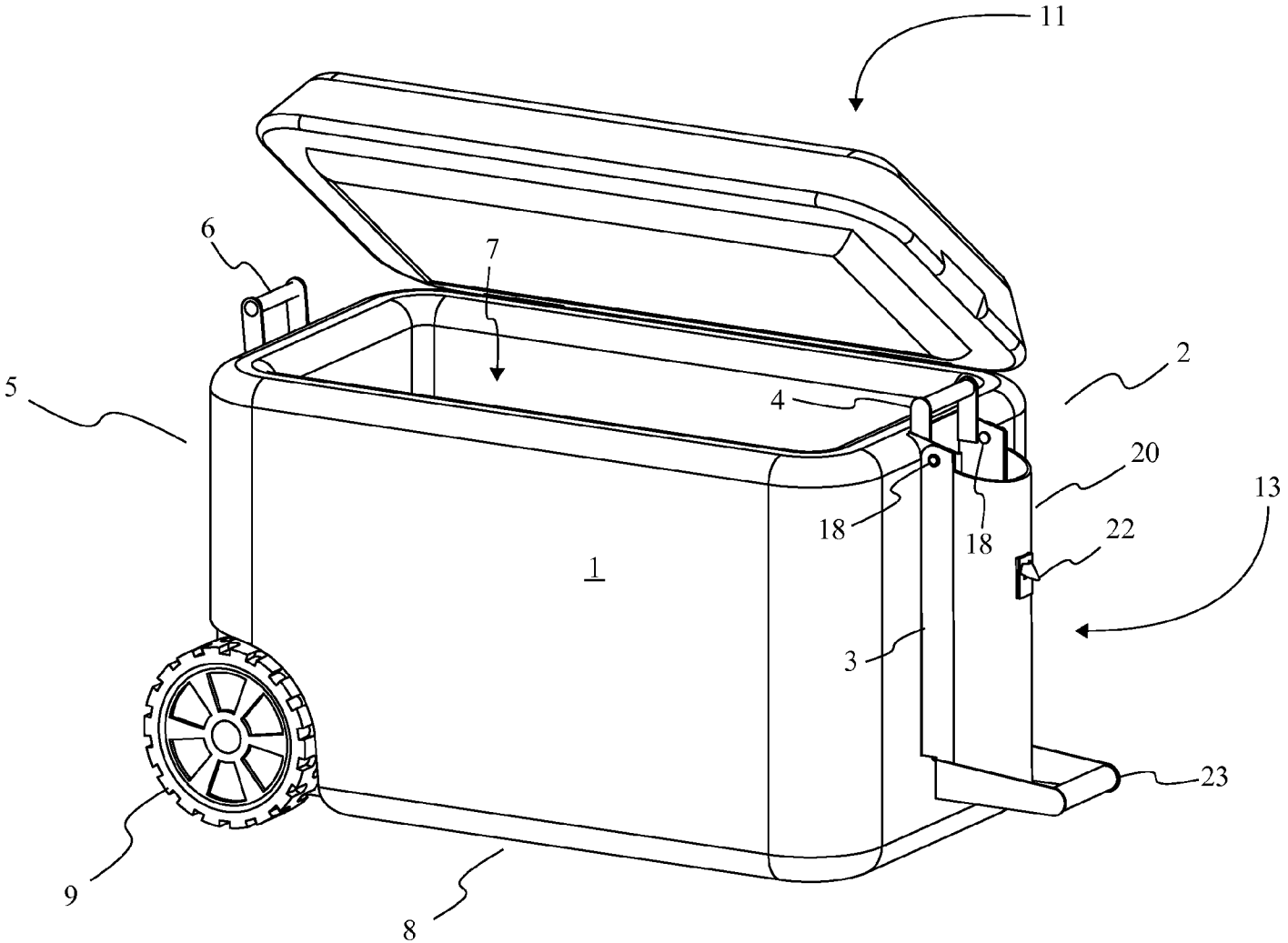
FIG. 2 is a front perspective view displaying the combination cooler and can crusher with the interior chamber accessible as per the current embodiment of the present invention.
Figure 3:
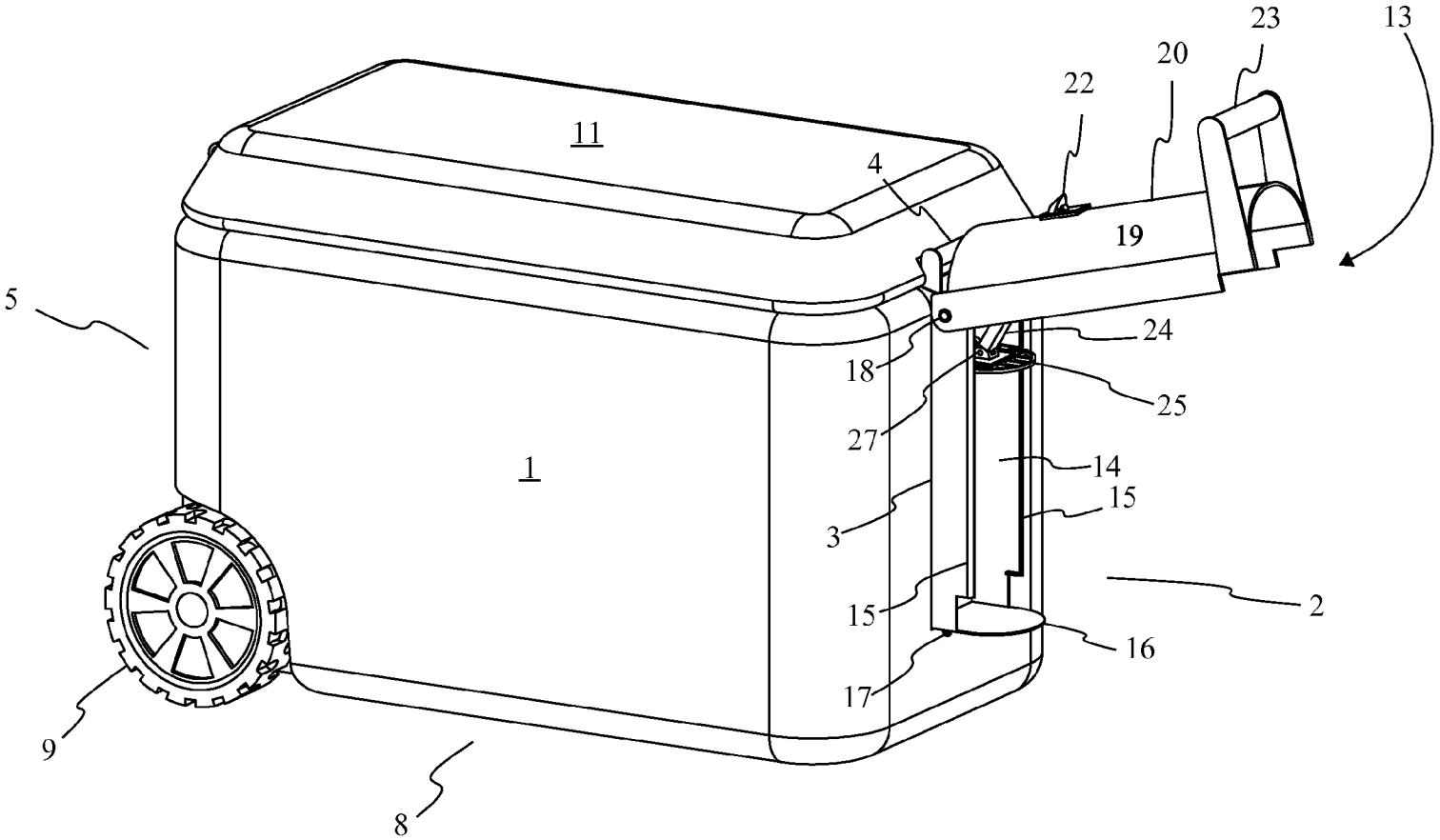
FIG. 3 is a front perspective view displaying the combination cooler and can crusher with the handle assembly in the open configuration as per the current embodiment of the present invention.

Referencing FIG. 1-3, a combination cooler and can crusher is a device that provides an insulated storage container with an integrally coupled means of compacting empty aluminium beverage cans. The device accomplishes both functions through a particular configuration that reduces functionally equivalent component redundancies. In the current embodiment of the present invention, the combination cooler and can crusher comprises a base section 1, a lid 11, and a handle assembly 13. The base section 1 is an insulated storage container that functions as the mounting point for the lid 11 and the handle assembly 13. The lid 11 functions as a detachable component that seals the base section 1 increasing the insulative capabilities of the combination cooler and can crusher. The handle assembly 13 is a dual function component that compacts empty aluminium cans and serves as an engagement point to the pull the combination cooler and can crusher during transport.

Referencing FIG. 1-3, the combination cooler and can crusher, in the current embodiment of the present invention, provides the handle assembly 13 as being a securely coupled component to the base section 1. The secure coupling provides the handle assembly 13 with an engagement capable of supporting the weight of a fully stocked base section 1 during transport. The lid 11 is provided as the portion of the device that removeably seals the base section 1. The lid 11 is an insulated cover that fully encloses the contents of the base section 1. With the lid 11 in place heat exchange between the contents of the base section 1 and the environment would be significantly reduced. The lid 11 is removeably attached to the base section 1 in order to temporarily provide access to the contents within the base section 1 preventing unwanted heat exchange.

Figure 5:
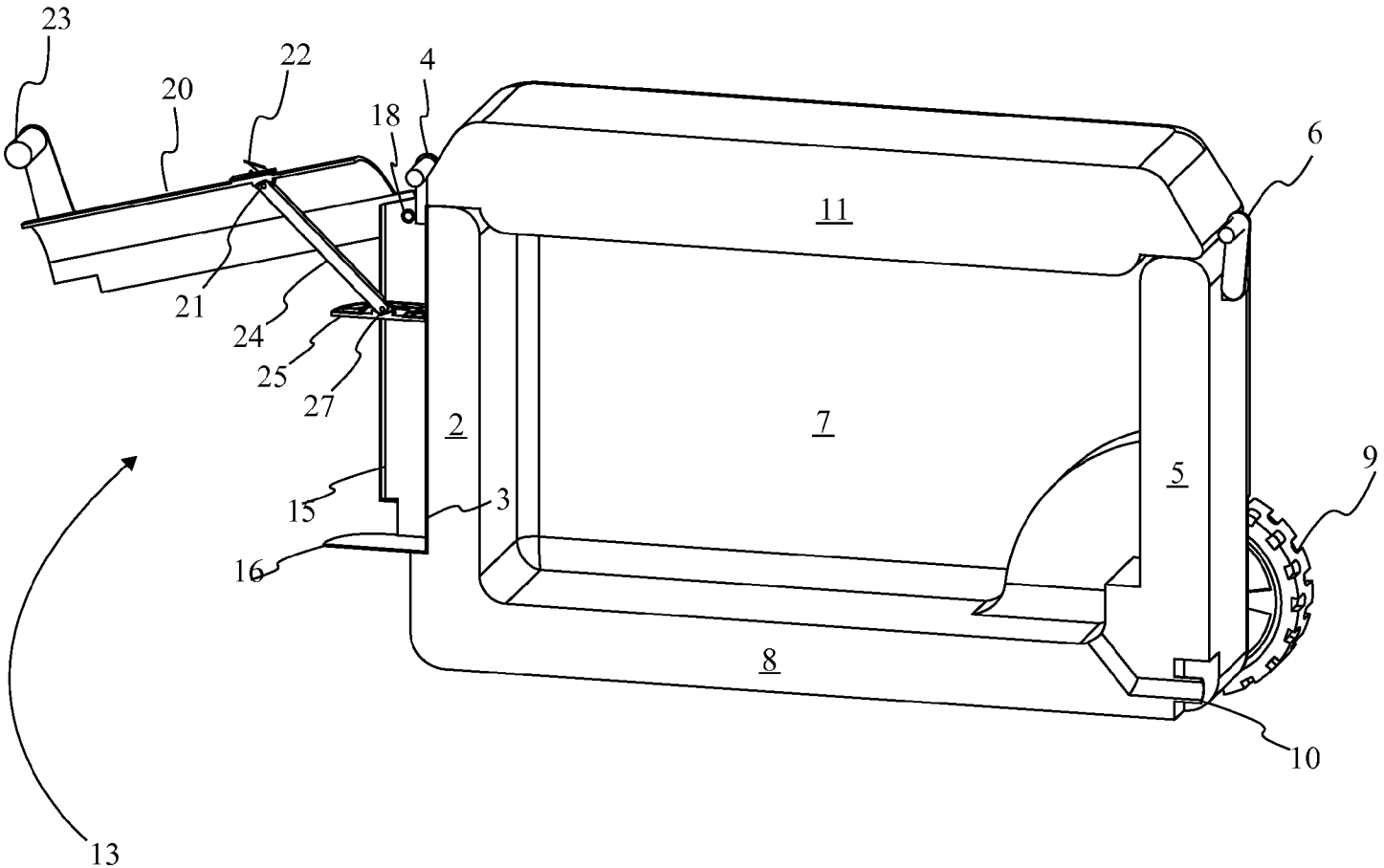
FIG. 5 is a cross sectional view displaying the internal component distribution as per the current embodiment of the present invention.

Referencing FIG. 1, FIG. 2, and FIG. 5, the base section 1 is an insulated storage container that functions as the mounting point for the lid 11 and the handle assembly 13. The base section 1 is provided with a predominantly geometric construction allowing surfaces of the base section 1 to have semi-planar features. In the current embodiment of the present invention the base section 1 comprises a front section 2, a rear section 5, an interior chamber 7, and a ground contacting section 8. The front section 2 is the portion of the base section 1 containing a lateral face side coincident with the handle assembly 13. The rear section 5 is the portion of the base section 1 containing the lateral face side opposite the front section 2. The ground contacting section 8 is the portion of the base section 1 that directly rests or engages a surface. It should be noted that the ground contacting section 8 is coincident with the front section 2 and the rear section 5, but should be regarded as being found below both the front section 2 and the rear section 5 unless otherwise noted. The interior chamber 7 is the portion of the base section 1 that holds items needing insulation. The interior chamber 7 is surrounded by the front section 2, the rear section 5, the ground contacting section 8, and the lid 11. The interior chamber 7 is removeably enclosed by the lid 11, wherein the removable enclosure is provided as a means of temporarily accessing the items stored within the interior chamber 7. The lid 11 is found positioned opposite the ground contacting section 8.

Referencing FIG. 1, FIG. 2, and FIG. 5, the front section 2 is provided as a region of the base section 1 that is engaged to the handle assembly 13. In the current embodiment of the present invention, the front section 2 comprises a handle assembly 13 mount 3 and a front carry handle 4. The handle assembly 13 mount 3 is provided as the engagement point between the handle assembly 13 and the front section 2. The engagement between the handle assembly 13 mount 3 and the handle assembly 13 is strong enough to support the load weight of a fully stocked interior chamber 7 while the base section 1 is being pulled by the handle assembly 13 during transport. It should be noted that the handle assembly 13 mount 3 may comprises any means of securing the handle assembly 13 to the front section 2. The front carry handle 4 is complimentary to a component of the rear section 5 that when used in conjunction allows for the facilitated lifting of the combination cooler and can crusher. It should be noted that the front carry handle 4 is provided primarily as a gripping surface on the front section 2 that does not interfere with the function of the handle assembly 13 or associated engagements of the lid 11. It should be noted that a fully stocked interior chamber 7 is an interior chamber 7 that has been filled to capacity with various items commonly housed within a cooler.

Referencing FIG. 1, FIG. 2, and FIG. 5, the rear section 5 is the region of the base section 1 that is found opposite the front section 2. In the current embodiment of the present invention, the rear section 5 comprises a rear carry handle 6. The rear carry handle 6 is complementary to the front carry handle 4 and when used in conjunction facilitates the lifting of the combination cooler and can crusher from one surface to another. The rear carry handle 6 and the front carry handle 4 are found positioned opposite to one another across the base section 1, wherein the opposite positioning allows a user to adequately balance the combination cooler and can crusher when lifting.

Referencing FIG. 5, the ground contacting section 8 is the portion of the base section 1 that rests against a surface when stationary or engages a surface when being transported. In the current embodiment of the present invention, the ground contacting section 8 comprises a wheel assembly 9 and a drainage spout 10. The wheel assembly 9 allows the base section 1 to be rolled across a surface when being pulled by the handle assembly 13. The wheel assembly 9 is particular configured to minimally interfere with the base section 1 when at rest. The drainage spout 10 is provided as a conduit that allows the draining of fluids from the interior chamber 7. The wheel assembly 9 is positioned distal to the rear carry handle 6 across the rear section 5. The positioning of the wheel assembly 9 facilitates the movement of the base section 1 when pulled by the handle assembly 13. During transportation, the front section 2 is raised higher than the rear section 5 angling the wheel assembly 9 in a manner that permits contact with a ground surface. The drainage spout 10 is in fluid communication with the interior chamber 7. The drainage spout 10 is positioned adjacent to the wheel assembly 9. The positioning of the drainage spout 10 facilitates the drainage of fluids from interior chamber 7 through the drainage spout 10 by pivoting the base section 1 about the wheel assembly 9.

Referencing FIG. 1, FIG. 2, and FIG. 5, the lid 11 is the portion of the combination cooler and can crusher that removeably covers the interior chamber 7 reducing the heat exchange. In the current embodiment of the present invention, the lid 11 comprises a hinge assembly 12. The hinge assembly 12 is the mechanism by which the lid 11 is able to achieve its removable positioning with the base section 1. The hinge assembly 12 permits the lid 11 to be pivotably coupled to the base section 1. The pivotal engagement allows the lid 11 to be coincident with the interior chamber 7 without detaching from the base section 1. although the hinge assembly's 12 positioning relative to the front section 2 and the rear section 5 is not specified, it should be noted that the hinge assembly 12 can be found anywhere on the base section 1 provided that the positioning does not hinder or interfere with the function of the handle assembly 13.

Figure 6:
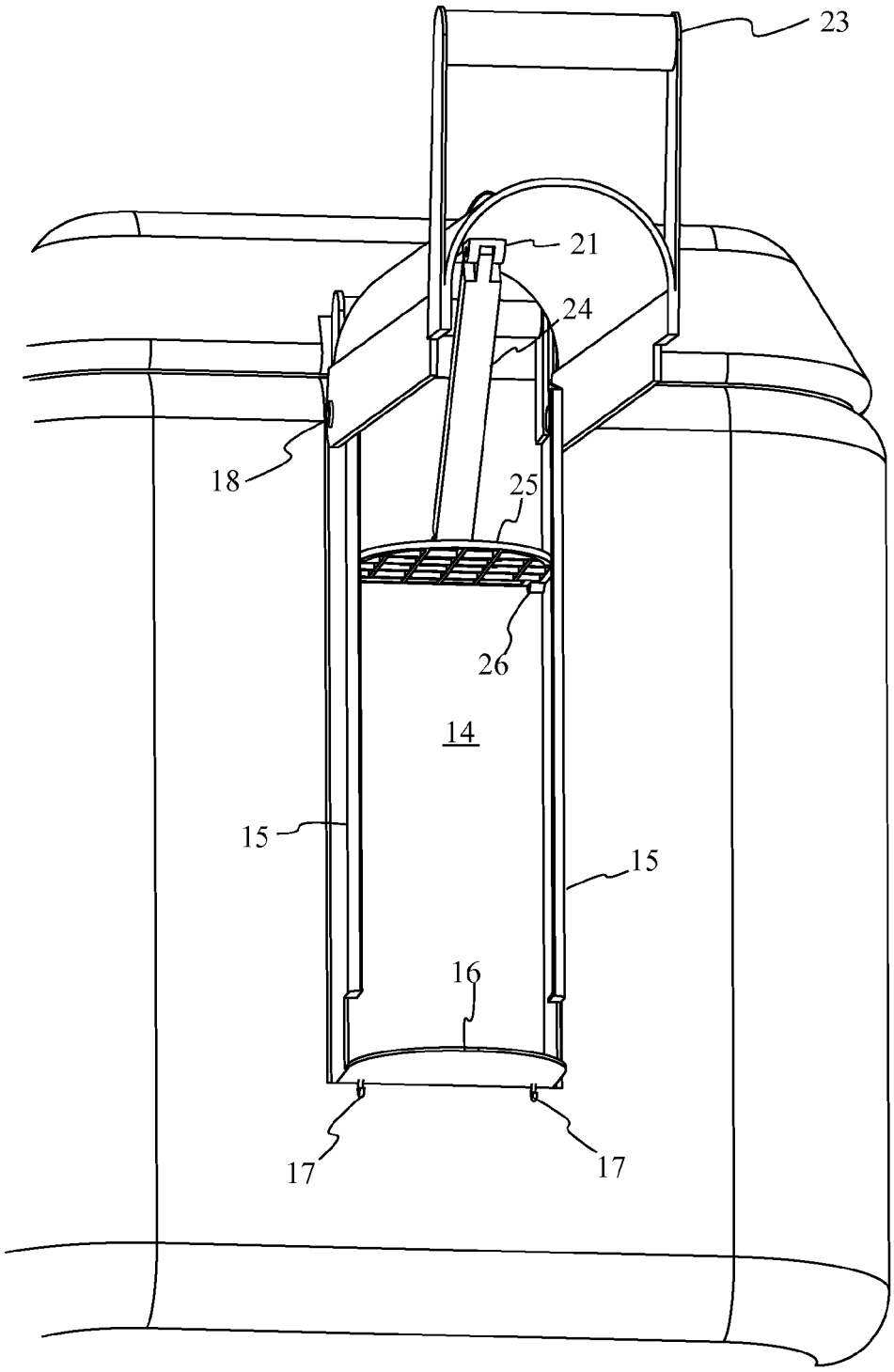
FIG. 6 is an enhanced view displaying the components of the handle assembly as per the current embodiment of the present invention.

Referencing FIG. 1, FIG. 3, and FIG. 6, the handle assembly 13 is a dual function component that compacts empty aluminium cans and functions as an engagement point to pull the combination cooler and can crusher during transport. In the current embodiment of the present invention, the handle assembly 13 comprises a lever base 14, a lever handle 19, a linkage rod 24, and a crushing plate 25. The lever base 14 is provided as a static structure that engages the base section 1 and provides structural features that permit mechanical interactions with the lever handle 19 and the crushing plate 25. The lever handle 19 functions as a lever arm whose movement is translated to the crushing plate 25. The lever handle 19 additionally functions as the engagement point for pulling the combination cooler and can crusher during transport. The crushing plate 25 is the mechanical component that operates in conjunction with the lever base 14 in order to compact empty aluminium beverage cans. The linkage rod 24 is a coupler that translates movement from the lever handle 19 to the crushing plate 25.

Referencing FIG. 6, the lever base 14 is the static structural component of the handle assembly 13 that is securely coupled to the base section 1. The lever base 14 is securely coupled to the front section 2 of the base section 1 by way of the handle assembly 13 mount 3. Although, the engagement between the lever base 14 and the handle assembly 13 is not specifically described, it should be noted that the engagement can be accomplished by any means provided the engagement supports the weight of a full stocked base section 1. In the current embodiment of the present invention, the lever base 14 comprises plate rails 15, a platform 16, and a lever hinge 18. The plate rails 15 are channels utilized to align the crushing plate 25 when mechanically operated. The platform 16 is the portion of the lever base 14 upon which an empty aluminium beverage can is placed. The platform 16 is the surface which the empty aluminium beverage can is compacted against. The lever hinge 18 functions as the engagement point between the lever base 14 and the lever handle 19. The lever hinge 18 is a pivot point about which the lever handle 19 is able to rotate from a vertical position coincident with portions of the lever base 14 to an angular position that is less than 90° relative to horizontal. The lever hinge 18 is positioned opposite the platform 16 along the length of the lever base 14. The platform 16 is positioned proximal to the ground contacting section 8. The positioning of the platform 16 orients the lever base 14 in a particular manner that places the lever hinge 18 adjacent to the lid 11. The plate rails 15 are positioned between the platform 16 and the lever hinge 18. The positioning of the plate rails 15 provides the crushing plate 25 with a limited path that limits the movement of the lever handle 19 by association.

Figure 4:
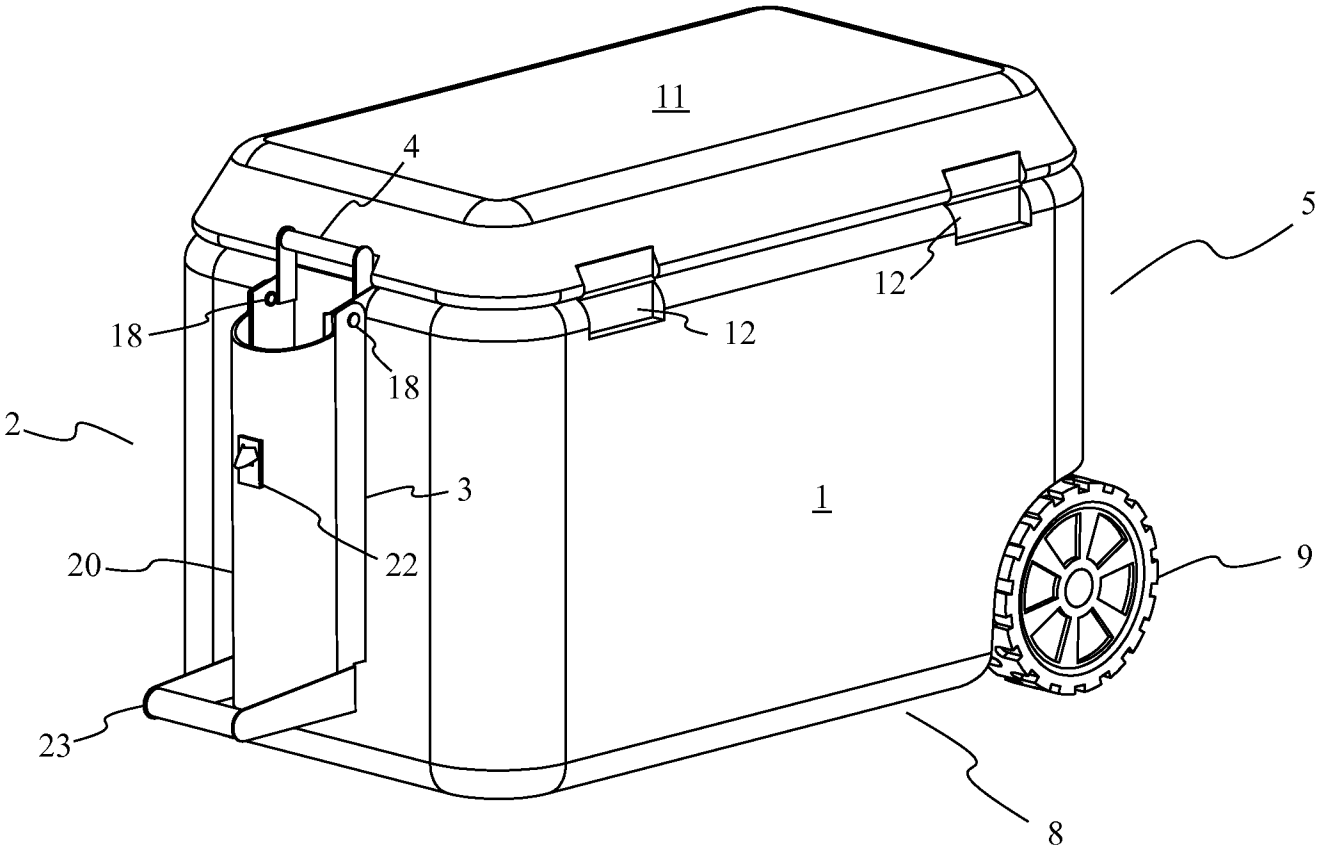
FIG. 4 is a rear perspective view displaying the engagement between lid and the base section as per the current embodiment of the present invention.

Referencing FIG. 4 and FIG. 6, the lever hinge 18 is the component that engages the lever handle 19 enabling the lever handle 19 to pivot and mechanically interact with the crushing plate 25 by way of the linkage rod 24. The lever hinge 18 is a coupling capable of supporting the weight of a fully stocked base section 1 while being pulled by the lever handle 19 during transport.

Figure 7:
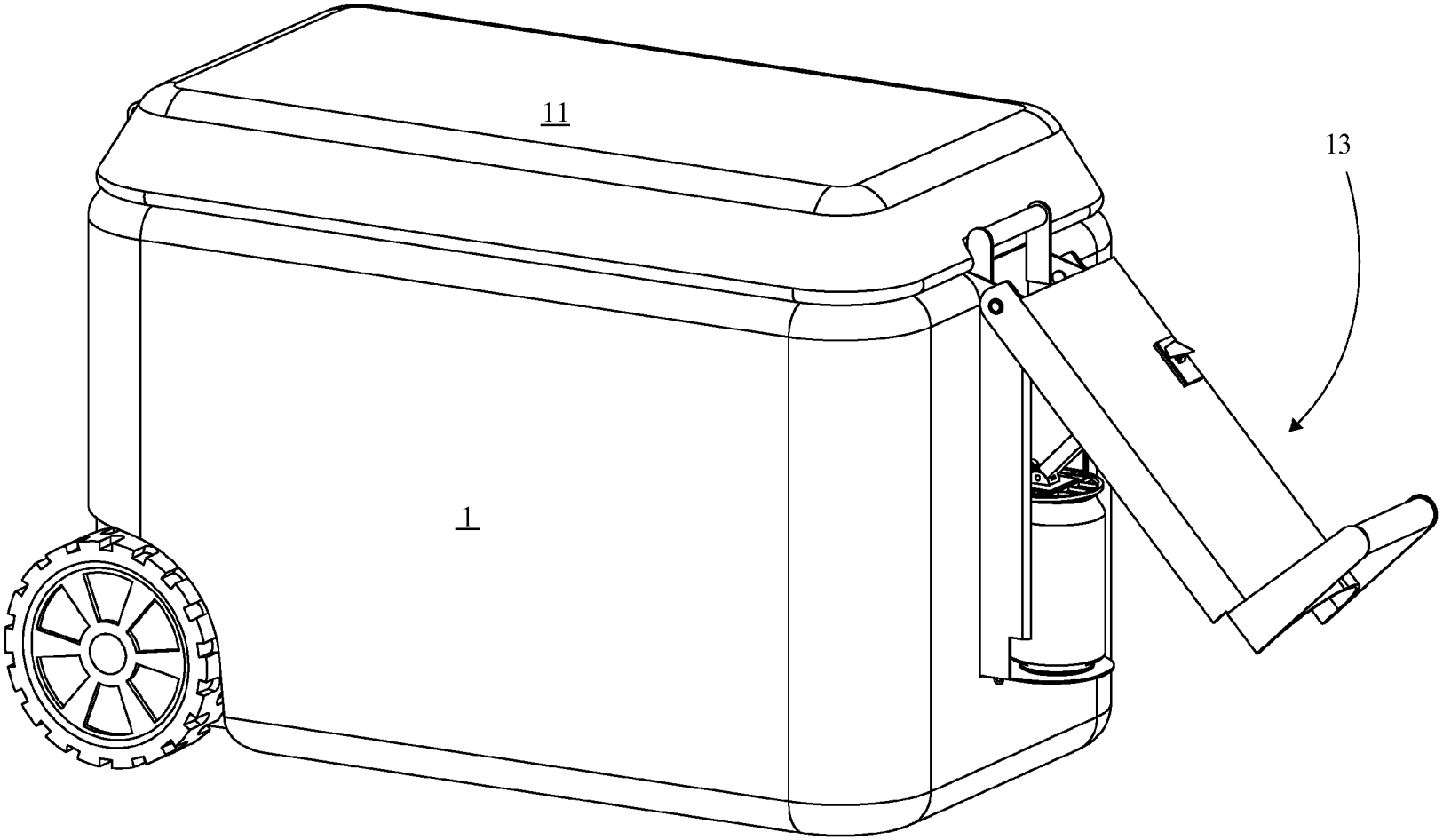
FIG. 7 is a perspective view of the handle assembly in the open configuration with an aluminium beverage can positioned on the platform as per the current embodiment of the present invention.
Figure 8:
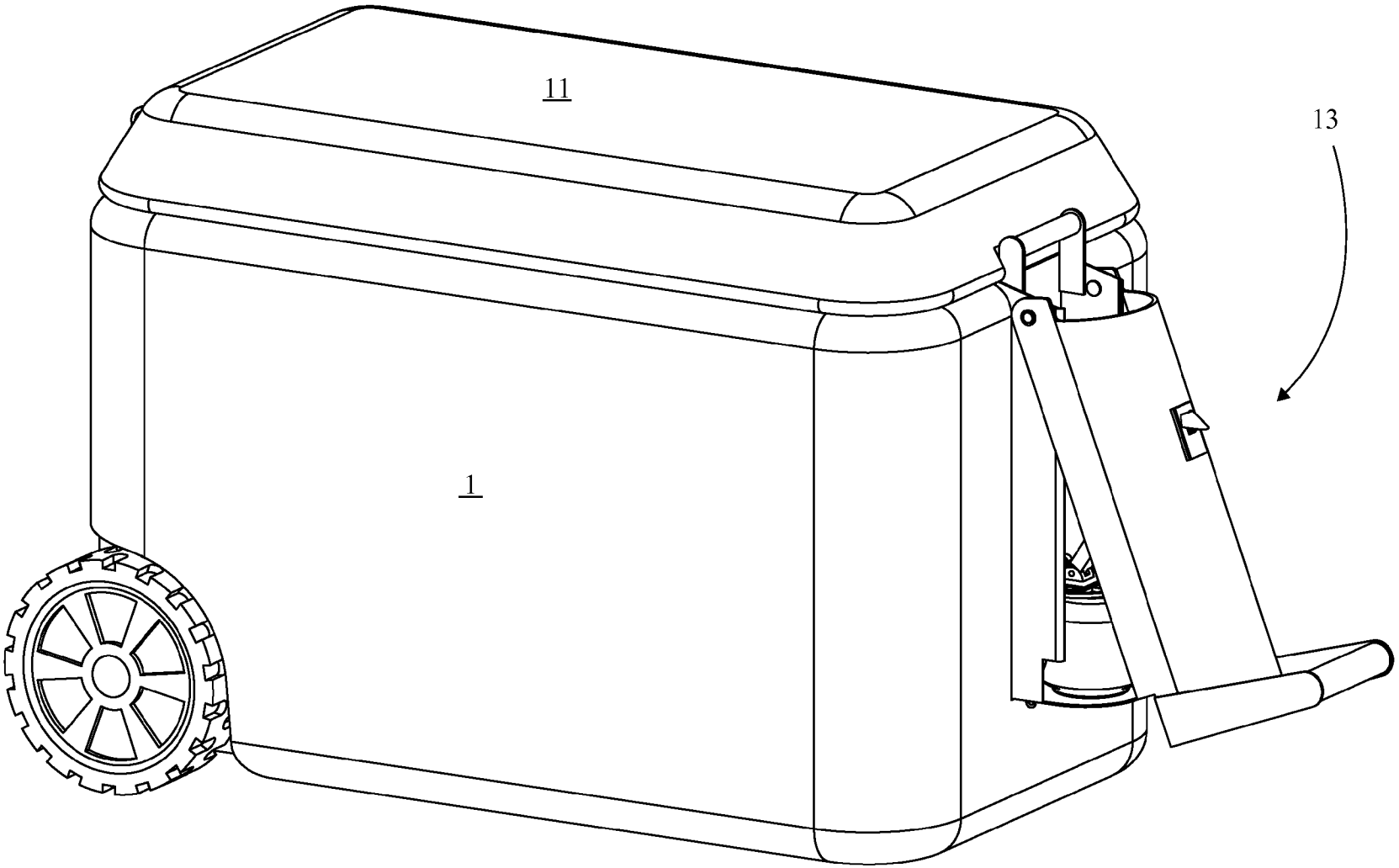
FIG. 8 is a perspective view of the handle assembly in the crushing an aluminium beverage can positioned on the platform as per the current embodiment of the present invention.

Referencing FIG. 6-8, the platform 16 is the surface which empty aluminium beverage cans are compacted against. In the current embodiment of the present invention, the platform 16 comprises a trash bag mount 17. The trash bag mount 17 is positioned on the lower portion of the platform 16 opposite the positioning of the plate rails 15. The trash bag mount 17 functions as a means of securing a trash bag beneath the platform 16 for the purposes of collecting compacted aluminium beverage cans. The trash bag mount 17 would provide a detachable engagement with a trash bag allowing the trash bag to be replaced if needed. The trash bag mount 17 additionally includes features that facilitate the deposit of crushed aluminium cans by keeping a trash bag readily open.

Referencing FIG. 6-8, the crushing plate 25 is the component of the handle assembly 13 that compacts empty aluminium beverages cans against the platform 16. In order to accomplish this task the crushing plate 25 is aligned parallel to the platform 16. In the current embodiment of the present invention, the plate comprises plate guides 26 and a second pivot mount 27. The crushing plate 25 is moveably coupled to the plate rails 15 by way of the plate guides 26. The plate guides 26 function as elements of the crushing plate 25 that coincide with the plate rails 15 of the lever base 14. The plate guide traverse along the plate rails 15. The plate guides 26 allow the crushing plate 25 to maintain a parallel alignment with the platform 16 while moving along the length of the lever base 14. The second pivot mount 27 functions as a pivotal engagement point between the crushing plate 25 and the linkage rod 24. The second pivot mount 27 allows the linkage rod 24 to translate a range of motion into linear motion of the crushing plate 25 along the path provided by the plate rails 15. The second pivot mount 27 is found positioned opposite the platform 16 on the crushing plate 25.

Referencing FIG. 5-8, the linkage rod 24 is the mechanical linkage that manages the input movement of the lever handle 19 and translates it to the movement of the crushing plate 25. The linkage rod 24 is provided with a length enables the pivoting motion of the lever handle 19 to translate into movement of the crushing plate 25. The linkage rod 24 is pivotally coupled to the crushing plate 25 by way of the second pivot mount 27. The linkage rod 24 is pivotally coupled to the lever handle 19 by way of a first pivot mount 21. It should be noted that the linkage rod 24 may be constructed of any material rigid enough to translate the force required to compact an empty aluminium beverage can.

Referencing FIG. 5-8, the lever handle 19 is the pivoting component of the handle assembly 13 that functions as an elongated handle for pulling the base section 1 during transport as well as the lever that operates the linkage mechanism that moves the crusher plate. The lever handle 19 pivots about the lever hinge 18 between two positions an extended position and a closed position. The closed position places the lever handle 19 coincident with portions of the lever base 14 and reduces the distances between the crusher plate and the platform 16 to its lowest point. The extended position of the lever handle 19 is an angular position that is less than 90° from the horizontal and extends the distance between the crusher plate and the platform 16 to its greatest value. The lever handle 19 is pivotably coupled to the lever base 14 by way of the lever hinge 18. The engagement of the elongated body 20 with the lever hinge 18 provides the lever handle 19 with a fixed point to pivot about. In the current embodiment of the present invention, the lever handle 19 comprises an elongated body 20, and a primary handle 23. The lever hinge 18 is engaged to the elongated body 20 opposite the primary handle 23. The elongated body 20 is the portion of the lever handle 19 that extends the positioning of the primary handle 23 from the lever hinge 18. The elongated body 20 is a rigid structure that is pivotally coupled to the lever hinge 18. The primary handle 23 is the engageable portion of the lever handle 19 that allows a user to pivot the elongated body 20 about the lever hinge 18. The elongated body 20 is arcuately coincident with the platform 16, wherein the arc path of the elongated body 20 about the lever hinge 18 aligns the elongated body 20 with the platform 16 when the elongated body 20 is in the closed position. The primary handle 23 is arcuately positioned between the platform 16 and the ground contacting section 8. The primary handle 23 is the furthest extension of the elongated body 20, as a result, the arcuate path of the primary handle 23 is positioned in a manner that does not cause interference with the surface upon which the ground contacting section 8 is resting on.

Referencing FIG. 5-8, the elongated body 20 is the portion of the lever handle 19 that extends the positioning of the primary handle 23 away from the lever hinge 18. In the current embodiment of the present invention, the elongated body 20 comprises a bottle opener 22 and a first pivot mount 21. The first pivot mount 21 is the portion of the elongated body 20 that is pivotably coupled to the linkage rod 24. The first pivot mount 21 functions as the joint that translates motion from the lever handle 19 across the linkage rod 24 to the crusher plate. The first pivot mount 21 is positioned between the lever hinge 18 and the primary handle 23. The bottle opener 22 is a component that provides the combination cooler and can crusher with a means of up capping bottled beverages. The bottle opener 22 is peripherally positioned on the elongated body 20. It should be noted that the functionality of the bottle opener 22 can be accomplished by positioning the bottle opener 22 on the lid 11 or the base section 1 of the combination cooler and can crusher.

Although the invention has been explained in relation to its preferred embodiment, it is to be understood that many other possible modifications and variations can be made without departing from the spirit and scope of the invention as hereinafter claimed.

What is claimed is:

1. A combination cooler and can crusher comprises:

a base section;

a lid;

a handle assembly;

the base section comprises a front section, a rear section, an interior chamber, and a ground contacting section;

the lid comprises a hinge assembly;

the handle assembly comprises a lever base, a lever handle, a linkage rod, and a crushing plate;

the front section comprises a handle assembly mount and a front carry handle;

the rear section comprises a rear carry handle;

the ground contacting section comprises a wheel assembly and a drainage spout;

the lever base comprises plate rails, a platform, and a lever hinge;

the lever handle comprises an elongated body and a primary handle;

the crushing plate comprises plate guides and a second pivot mount;

the platform comprises a trash bag mount;

the elongated body comprises a first pivot mount and a bottle opener;

the handle assembly being securely coupled to the base section;

the base section being sealed by the lid; and the lid being removeably attached to the base section.

2. The combination cooler and can crusher as claimed in claim 1 comprises:

the lid is positioned opposite the ground contacting section, wherein the ground contacting section is positioned opposite the lid across the base section;

the interior chamber being surrounded by the front section, the rear section, the lid, and the ground contacting section;

the interior chamber being removeably enclosed by the lid; and the lid being pivotably coupled to the base section by way of the hinge assembly.

3. The combination cooler and can crusher as claimed in claim 1 comprises:

the front carry handle being positioned opposite the rear carry handle, wherein the positioning of the front carry handle on the front section is opposite the positioning of the rear carry handle on the rear section across the base section;

the wheel assembly being positioned distal from the rear carry handle across the rear section;

the drainage spout being positioned adjacent to the wheel assembly; and the drainage spout being in fluid communication with the interior chamber.

4. The combination cooler and can crusher as claimed in claim 1 comprises:

the lever base being securely coupled to the front section by way of the handle assembly mount;

the lever handle being pivotably coupled to the lever base by way of the lever hinge;

the lever hinge being positioned opposite the platform;

the platform being positioned proximal to the ground contacting section;

the plate rails being positioned along length of the lever base;

the plate rails being positioned between the platform and the lever hinge; and the trash bag mount being positioned on the platform opposite the plate rails.

5. The combination cooler and can crusher as claimed in claim 1 comprises:

the crushing plate being movably coupled to the plate rails by way of the plate guides;

the crushing plate being mechanically linked to the lever handle by way to the linkage rod;

the crushing plate being aligned parallel to the platform;

the linkage rod being pivotably coupled to the crushing plate by way of the second pivot mount; and the second pivot mount being positioned opposite the platform on the crushing plate.

6. The combination cooler and can crusher as claimed in claim 1 comprises:

the lever hinge being engaged to the elongated body opposite the primary handle;

the elongated body being arcuately coincident with the platform, wherein the arcuate path of the elongated body about the lever hinge aligns the elongated body coincident with the platform;

the primary handle being arcuately positioned between the platform and the ground contacting section, wherein the arcuate path of the primary handle about the lever hinge aligns the primary handle between the platform and the ground contacting section;

the linkage rod being pivotably coupled to the elongated body by way of the first pivot mount;

the first pivot mount being positioned between the lever hinge and the primary handle; and the bottle opener being peripherally positioned on the elongated body.

7. A combination cooler and can crusher comprises:

a base section;

a lid;

a handle assembly;

the base section comprises a front section, a rear section, an interior chamber, and a ground contacting section;

the lid comprises a hinge assembly;

the handle assembly comprises a lever base, a lever handle, a linkage rod, and a crushing plate;

the front section comprises a handle assembly mount and a front carry handle;

the rear section comprises a rear carry handle;

the ground contacting section comprises a wheel assembly and a drainage spout;

the lever base comprises plate rails, a platform, and a lever hinge;

the lever handle comprises an elongated body and a primary handle;

the crushing plate comprises plate guides and a second pivot mount;

the platform comprises a trash bag mount;

the elongated body comprises a first pivot mount and a bottle opener;

the handle assembly being securely coupled to the base section;

the base section being sealed by the lid;

the lid being removeably attached to the base section;

the lid is positioned opposite the ground contacting section, wherein the ground contacting section is positioned opposite the lid across the base section;

the interior chamber being surrounded by the front section, the rear section, the lid, and the ground contacting section;

the interior chamber being removeably enclosed by the lid; and the lid being pivotably coupled to the base section by way of the hinge assembly.

8. The combination cooler and can crusher as claimed in claim 7 comprises:

the front carry handle being positioned opposite the rear carry handle, wherein the positioning of the front carry handle on the front section is opposite the positioning of the rear carry handle on the rear section across the base section;

the wheel assembly being positioned distal from the rear carry handle across the rear section;

the drainage spout being positioned adjacent to the wheel assembly;

the drainage spout being in fluid communication with the interior chamber;

the lever base being securely coupled to the front section by way of the handle assembly mount;

the lever handle being pivotably coupled to the lever base by way of the lever hinge;

the lever hinge being positioned opposite the platform;

the platform being positioned proximal to the ground contacting section;

the plate rails being positioned along length of the lever base;

the plate rails being positioned between the platform and the lever hinge; and the trash bag mount being positioned on the platform opposite the plate rails.

9. The combination cooler and can crusher as claimed in claim 7 comprises:

the crushing plate being movably coupled to the plate rails by way of the plate guides;

the crushing plate being mechanically linked to the lever handle by way to the linkage rod;

the crushing plate being aligned parallel to the platform;

the linkage rod being pivotably coupled to the crushing plate by way of the second pivot mount;

the second pivot mount being positioned opposite the platform on the crushing plate;

the lever hinge being engaged to the elongated body opposite the primary handle;

the elongated body being arcuately coincident with the platform, wherein the arcuate path of the elongated body about the lever hinge aligns the elongated body coincident with the platform;

the primary handle being arcuately positioned between the platform and the ground contacting section, wherein the arcuate path of the primary handle about the lever hinge aligns the primary handle between the platform and the ground contacting section;

the linkage rod being pivotably coupled to the elongated body by way of the first pivot mount;

the first pivot mount being positioned between the lever hinge and the primary handle; and the bottle opener being peripherally positioned on the elongated body.

10. A combination cooler and can crusher comprises:

a base section;

a lid;

a handle assembly;

the base section comprises a front section, a rear section, an interior chamber, and a ground contacting section;

the lid comprises a hinge assembly;

the handle assembly comprises a lever base, a lever handle, a linkage rod, and a crushing plate;

the front section comprises a handle assembly mount and a front carry handle;

the rear section comprises a rear carry handle;

the ground contacting section comprises a wheel assembly and a drainage spout;

the lever base comprises plate rails, a platform, and a lever hinge;

the lever handle comprises an elongated body and a primary handle;

the crushing plate comprises plate guides and a second pivot mount;

the platform comprises a trash bag mount;

the elongated body comprises a first pivot mount and a bottle opener;

the handle assembly being securely coupled to the base section;

the base section being sealed by the lid;

the lid being removeably attached to the base section;

the lid is positioned opposite the ground contacting section, wherein the ground contacting section is positioned opposite the lid across the base section;

the interior chamber being surrounded by the front section, the rear section, the lid, and the ground contacting section;

the interior chamber being removeably enclosed by the lid;

the lid being pivotably coupled to the base section by way of the hinge assembly;

the front carry handle being positioned opposite the rear carry handle, wherein the positioning of the front carry handle on the front section is opposite the positioning of the rear carry handle on the rear section across the base section;

the wheel assembly being positioned distal from the rear carry handle across the rear section;

the drainage spout being positioned adjacent to the wheel assembly;

the drainage spout being in fluid communication with the interior chamber;

the lever base being securely coupled to the front section by way of the handle assembly mount;

the lever handle being pivotably coupled to the lever base by way of the lever hinge;

the lever hinge being positioned opposite the platform;

the platform being positioned proximal to the ground contacting section;

the plate rails being positioned along length of the lever base;

the plate rails being positioned between the platform and the lever hinge;

the trash bag mount being positioned on the platform opposite the plate rails;

the crushing plate being movably coupled to the plate rails by way of the plate guides;

the crushing plate being mechanically linked to the lever handle by way to the linkage rod;

the crushing plate being aligned parallel to the platform;

the linkage rod being pivotably coupled to the crushing plate by way of the second pivot mount;

the second pivot mount being positioned opposite the platform on the crushing plate;

the lever hinge being engaged to the elongated body opposite the primary handle;

the elongated body being arcuately coincident with the platform, wherein the arcuate path of the elongated body about the lever hinge aligns the elongated body coincident with the platform;

the primary handle being arcuately positioned between the platform and the ground contacting section, wherein the arcuate path of the primary handle about the lever hinge aligns the primary handle between the platform and the ground contacting section;

the linkage rod being pivotably coupled to the elongated body by way of the first pivot mount;

the first pivot mount being positioned between the lever hinge and the primary handle; and the bottle opener being peripherally positioned on the elongated body.

* * * * *